US005209271A

United States Patent [19]

Takegawa

[11] Patent Number: 5,209,271

[45] Date of Patent: May 11, 1993

[54] MISPICKED WEFT REMOVING METHOD

[75] Inventor: Yujiro Takegawa, Kahoku, Japan

[73] Assignee: Tsudakoma Corporation, Ishikawa, Japan

[21] Appl. No.: 811,934

[22] Filed: Dec. 23, 1991

[30] Foreign Application Priority Data

Dec. 28, 1990 [JP] Japan ..... 2-418684

[51] Int. Cl.[5] ..... D03D 47/30

[52] U.S. Cl. ..... 139/116.2

[58] Field of Search ..... 139/116.2

[56] References Cited

U.S. PATENT DOCUMENTS 4,502,512 3/1985 Suzuki et al. ..... 139/116.2
4,635,686 1/1987 Terasaki ..... 139/116.2
4,688,606 8/1987 Tamatani .
4,821,779 4/1989 Shaw ..... 139/116.2
4,941,513 7/1990 Shaw .
5,005,609 4/1991 Volland et al. ..... 139/116.2

FOREIGN PATENT DOCUMENTS 59-21757 2/1984 Japan .
62-6938 1/1987 Japan .

*Primary Examiner*—Andrew M. Falik
*Attorney, Agent, or Firm*—Wenderoth, Lind & Ponack

[57] ABSTRACT

A mispicked weft removing method keeps a mispicked weft continuous with a weft remaining in the main picking nozzle of the loom, and inserts the weft additionally in the shed so that the weft extends in a loop in the shed, and then places a yarn guide in the loop of the weft, and pulls the weft toward the picking side. Since the mispicked weft is pulled via the yarn guide toward the picking side of the loom, a pulling force applied to the weft to remove the mispicked weft from the shed is effectively available for separating the mispicked weft from the cloth fell.

6 Claims, 6 Drawing Sheets

MISPICKED WEFT REMOVING METHOD

BACKGROUND OF THE INVENTION

1. Field of the Invention

The present invention relates to a method of removing a mispicked weft from a shed by pulling the mispicked weft from the picking side.

2. Description of the Prior Art

A method disclosed in U.S. Pat. No. 4,688,606 (EPA 0200168) keeps a mispicked weft connected to the weft remaining in a main picking nozzle and pulls the mispicked weft toward the picking side to separate and remove the mispicked weft from the cloth fell.

However, the pulling force applied to the mispicked weft does not act effectively for separating the mispicked weft from the cloth fell. If an increased pulling force is applied to the mispicked weft to increase the force available from separating the mispicked weft from the cloth fell, the mispicked weft is liable to be broken and hence the mispicked weft cannot stably be removed. Accordingly, this method is only useable for situations in which the woven fabric comprises a specific weft or a specific weave.

Another method of removing a mispicked weft disclosed in U.S. Pat. No. 4,941,513 (EPA (0332257) grips the weft from which the mispicked weft extends with a feeder gripper to insert the weft in the shed, transfers the weft from the feeder gripper to a carrier gripper, moves the carrier gripper to the arriving side, namely, the side opposite the picking side, and removes the mispicked weft through the carrier gripper by a pulling means provided on the picking side.

This method separates the mispicked weft from the cloth fell by the movement of the feeder gripper into the shed and by the movement of the carrier gripper out of the shed. However, the mispicked weft is liable to be broken while it is being separated from the cloth fell, and the mispicked weft is liable to be unsuccessfully transferred from the feeder gripper to the carrier gripper.

A third method disclosed in U.S. Pat. No. 4,781,221 (EPA 0207470) reverses the loom in case mispicking occurs to find the shed in which a mispicked weft is inserted, inserts a weft continuous with the mispicked weft in the shed, and separates the mispicked weft from the cloth fell and removes it by sucking the inserted weft into a suction nozzle disposed on the arriving side opposite the picking side.

This method pulls off the mispicked weft by turning back the mispicked weft, and hence the pulling force applied to weft inserted in the shed acts effectively for separating the mispicked weft from the cloth fell, so that the mispicked weft an surely be separated from the cloth fell.

However, since it is difficult to insert the weft in a U-shape into the shed as deep as the side thereof opposite to the picking side and since the inserting path is unstable, the inserted weft is now always caught by the suction nozzle, so that the removing of the mispicked weft is not reliable.

SUMMARY OF THE INVENTION

Accordingly, it is an object of the present invention to provide a mispicked weft removing method capable of peeling off the mispicked weft from the cloth fell by applying a small pulling force thereto in the same way as the third known method and of surely removing the mispicked weft.

To achieve the object, the present invention provides a mispicked weft removing method comprising: keeping a mispicked weft continuous with a weft remaining in the picking nozzle of a loom; finding the shed in which the mispicked weft is inserted; inserting the weft in the shed so that the subsequently picked weft extends around a yarn guide in a loop in the shed, and pulling the mispicked weft from the picking side so that the mispicked weft is pulled via the yarn guide.

Since the mispicked weft is turned back toward the picking side at the yarn guide as it is pulled, the pulling force is effectively available for separating the mispicked weft from the cloth fell, so that the mispicked weft, even if the mispicked weft is liable to be caught in the warps, can surely be separated from the cloth fell. Since the misplaced weft need not be transferred between mechanical parts, the mispicked weft can surely and quickly be removed.

DETAILED DESCRIPTION OF THE PREFERRED EMBODIMENTS

First Embodiment

Figure 1:
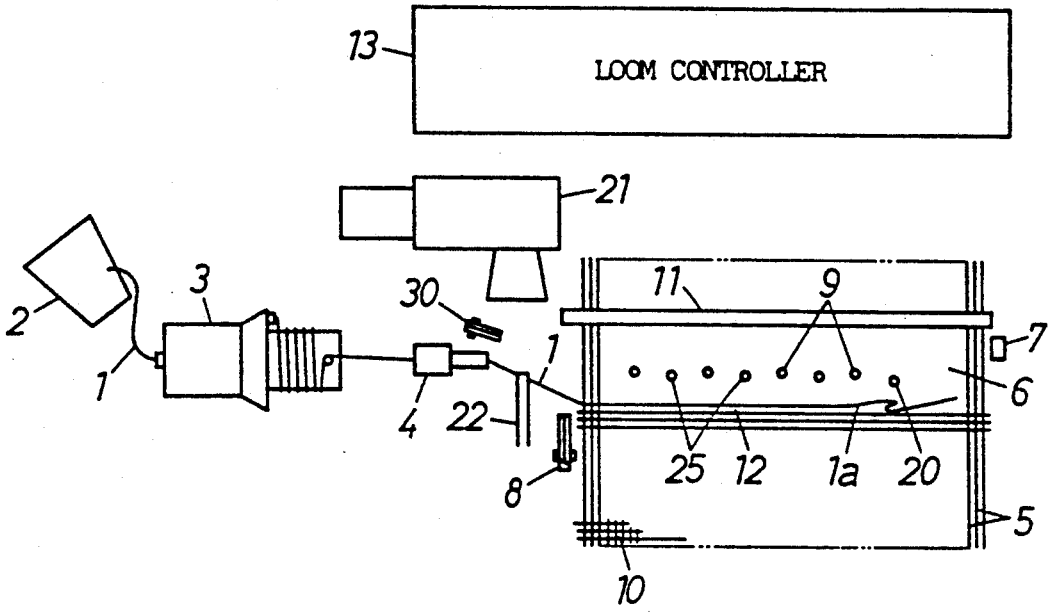
FIGS. 1 to 6 are schematic plan views of a loom in different phases of the cycle of operation for carrying out a mispicked weft removing method in accordance with a first embodiment of the present invention.

A mispicked weft removing method in accordance with a first embodiment of the present invention will be described in connection with the picking operation of a loom with reference to FIGS. 1 to 6.

Referring to FIGS. 1 to 6, a weft 1 of a length corresponding to the length of one pick unwound from a feed yarn package 2 is measured and stored for picking by a drum type weft measuring and storing device 3.

The weft 1 stored on the weft measuring and storing device 3 is released and is picked by a main picking nozzle 4 together with a picking fluid into a shed 6 of warps 5 at the picking phase. If necessary, the weft 1 picked into the shed 6 is urged in the running direction by air blow by a plurality of auxiliary picking nozzles 9 arranged along the path of the picked weft 1.

A reed 11 beats the weft 1 picked in the shed 6 into the cloth fell 12 by the beating motion thereof.

The normal arrival of the picked weft 1 at a predetermined position on the arriving side, i.e., the side opposite the picking side, of the loom is detected by a weft feeler 7 disposed on the arriving side. When the weft 1 is inserted normally in the shed 6, the picked weft 1 is beaten up by the read 11, the picked weft 1 is cut off the weft 1 remaining in the picking nozzle 4 with a yarn cutting device 8 at a position between the picking nozzle 4 and the selvage of the fabric on the picking side, and then the next picking cycle is started.

If the weft 1 is mispicked as shown in FIG. 1, the weft feeler 7 provides a weft stop signal. Then, a loom controller 13 stops the loom immediately, and stops the operation of the weft measuring and storing device 3 and the yarn cutting device 8. After the loom has been brought to a standstill, the loom is reversed and, consequently, the auxiliary picking nozzles 9 and a plurality of nozzles 25 fixed to the sley 15 of the loom advance into the shed 6, and the mispicked weft 1*a* continuous with the weft 1 remaining in the main picking nozzle 4 extends behind the cloth fell 12 in a free state.

Figure 2:
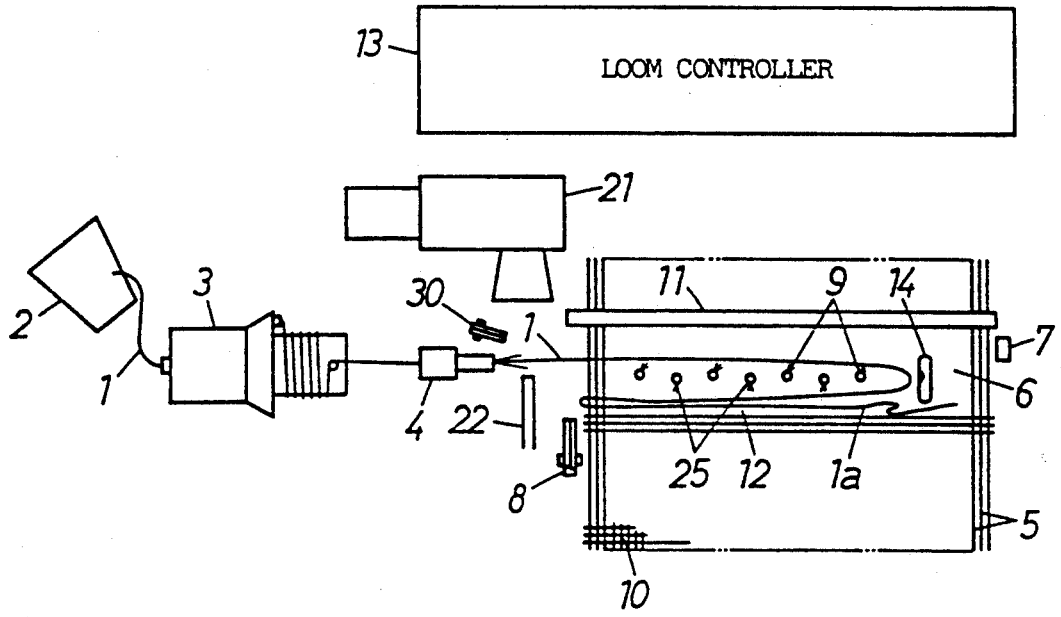
Figure 7:
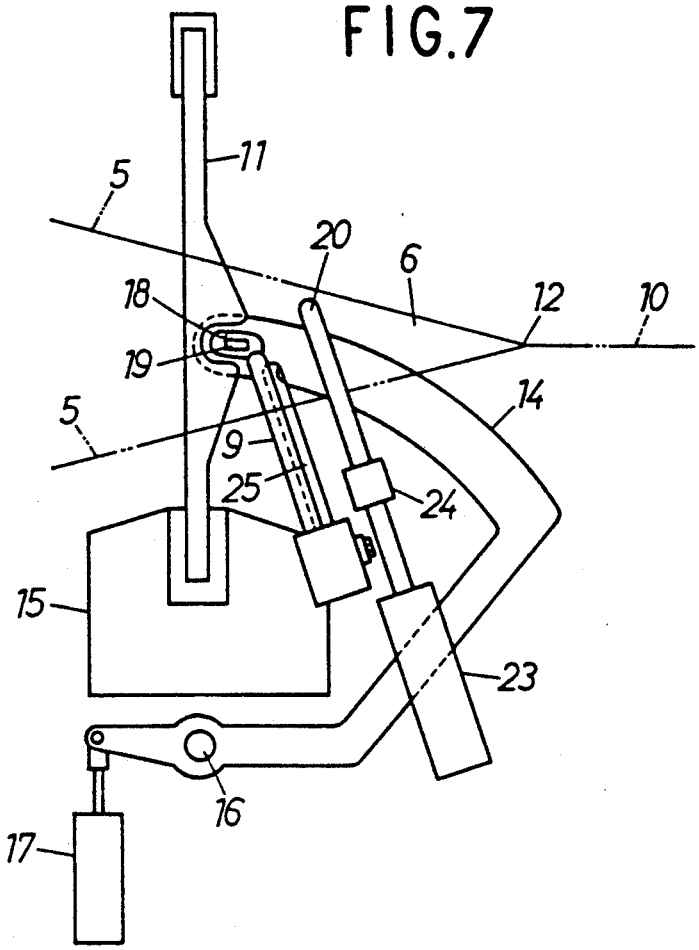
FIG. 7 is an enlarged side elevation showing a weft guide and a suction nozzle.

Then, as shown in FIG. 2, a suction nozzle 14 is advanced into the shed 6, the suction nozzle 14 starts suction and, at the same time, the auxiliary picking nozzles 9 and the nozzles 25 starts blowing. The nozzles 25 are set so as to blow air along the warps toward the cloth fell 12. It is preferable to set the nozzles 25 so as to blow air in a direction oblique to the cloth fell 12 and inclined slightly in the picking direction. As shown in FIG. 7, the suction nozzle 14 has, for example, the shape of the letter C, and has one end provided with a suction opening 18 and the other end supported for turning on a shaft 16. The suction nozzle 14 is moved by a pneumatic cylinder actuator 17 between an upper position and a lower position. When the suction nozzle 14 is turned to the upper position, the suction opening 18 is located opposite to the main picking nozzle 4 on the path of the picked weft 1.

Figure 3:
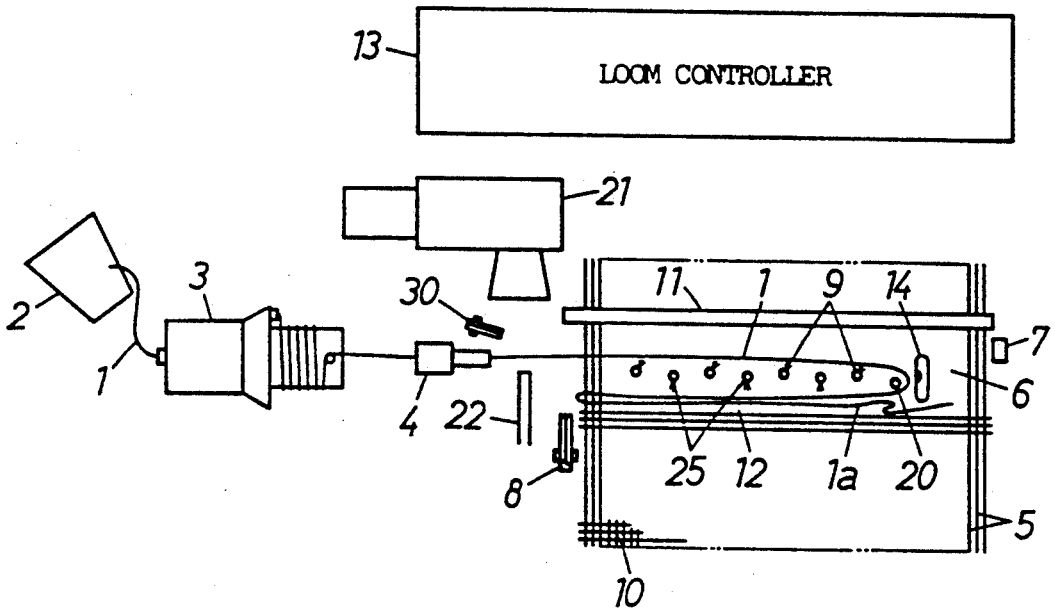

Subsequently, the weft measuring and storing device 3 releases the weft 1 of a length necessary for removing the mispicked weft 1*a*, and the weft 1 is inserted in the shed 6 of warps 5 by the jetting operation of the main picking nozzle 4 and the auxiliary picking nozzles 9. Then, the weft 1 inserted in the shed 6 and the mispicked weft 1*a* remaining in the shed 6 extend continuously in the shed 6 in a zigzag shape in a horizontal plane as shown in FIGS. 2 and 3. A portion of the weft 1 inserted in the shed 6, continuous with the mispicked weft 1*a* is urged toward the cloth fell 12 by air jetted by the nozzles 25, and another portion of the weft 1 extending from the main picking nozzle 4 is urged away from the cloth fell 12. Consequently, the weft 1 inserted in the shed 6 extends in a large loop of a shape resembling the letter U and the mispicked weft 1 remains continuous with the weft 1. In this state, the suction nozzle 14 applies suction continuously to the U-shaped bend in the weft 1 to maintain the loop of the weft 1 in the U-shape with a portion of the bend reaching a position outside of the shed. The nozzles 25 may be operated to jet air after the weft 1 has been inserted in the shed 6 and the U-shaped bend in the weft 1 has been sucked in the suction opening 18 of the suction nozzle 14.

Upon the suction of the U-shaped bend in the weft 1 in the suction opening 18 of the suction nozzle 14, a sensor provided within the suction nozzle 14 detects the normal insertion of the weft 1 in the shed 6. Then, a yarn guide 20 having the shape of a pin is advance from above or from below the warps 5 into the shed 6 and is located in the loop of the weft 1 as shown in FIG. 3. Then, the jetting operation of the main picking nozzle 4, the auxiliary picking nozzles 9 and the nozzles 25, and the sucking operation of the suction nozzle 14 are stopped.

As shown in FIG. 7, the yarn guide 20 is moved vertically by a yarn guide operating device 23, such as a pneumatic cylinder actuator, between a standby position outside the shed 6 and an operating position in the shed 6. The yarn guide 20 is moved to the operating position in removing the mispicked weft 1*a*. If necessary, the yarn guide 20 may be vibrated along the direction of extension of the warps or the wefts or may be rotated in the direction of pulling the weft 1 and the mispicked weft 1*a* by a driving device 24 operatively connected thereto to assist separating the mispicked weft 1*a* from the cloth fell 12 by vibration or exert an auxiliary pulling motion and to assist the pulling action of a mispicked weft removing device 21 by rotation.

Figure 4:
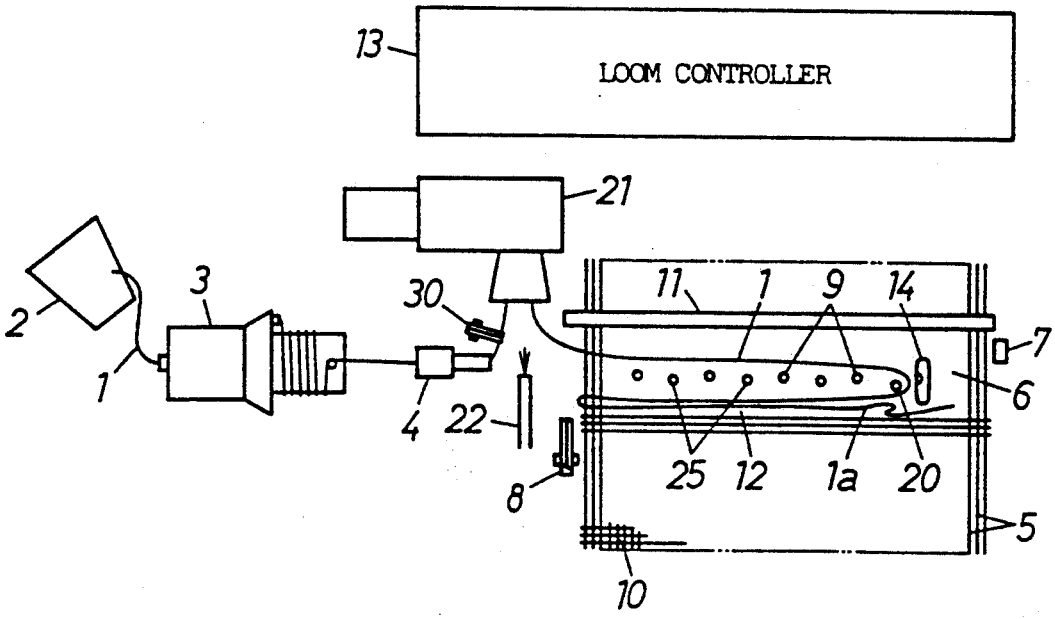

Then, the weft measuring and storing device 3 releases the weft 1 of a length necessary for moving the weft 1 to the mispicked weft removing device 21. Then, as shown in FIG. 4, a guide nozzle 22 jets a fluid against a portion of the weft 1 near the extremity of the main picking nozzle 4 to move a loose portion of the weft 1 into the mispicked weft removing device 21. Then, a cutting device 30 cuts the weft 1 at a position in front of the main picking nozzle 4 to separate the weft 1 remaining in the main picking nozzle 4 from the weft inserted in the shed 6. The mispicked weft removing device 21 may be a known pulling means, such as disclosed in U.S. Pat. No. 4,688,607 (EPA 0200168), that takes up the weft 1 with a pair of rollers, a known pulling means, such as disclosed in Japanese Laid-Open Patent Publication No. 59-21757, that takes up the weft 1 with a waste roller or a known pulling means that pulls the weft 1 with a hook. The mispicked weft removing device 21 pulls the weft 1 toward the picking side. The weft 1 is released additionally by the weft measuring and storing device 3 to enable the mispicked weft removing device 21 to catch the loose portion of the weft 1, however, the weft 1 need not be released additionally when the pulling device disclosed in, for example, U.S. Pat. No. 4,858,658 is employed as the mispicked weft removing device 21.

Figure 5:
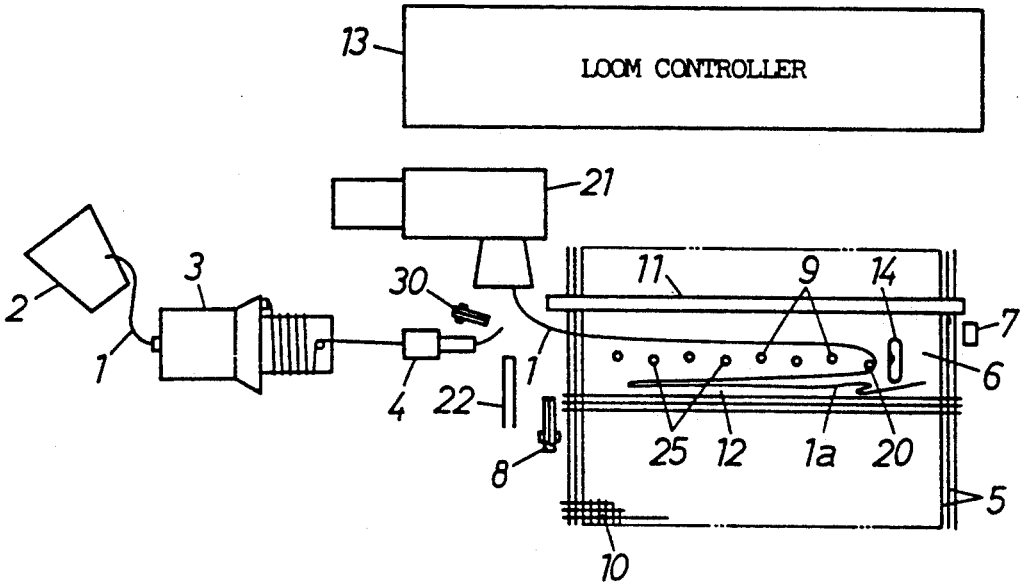
Figure 6:
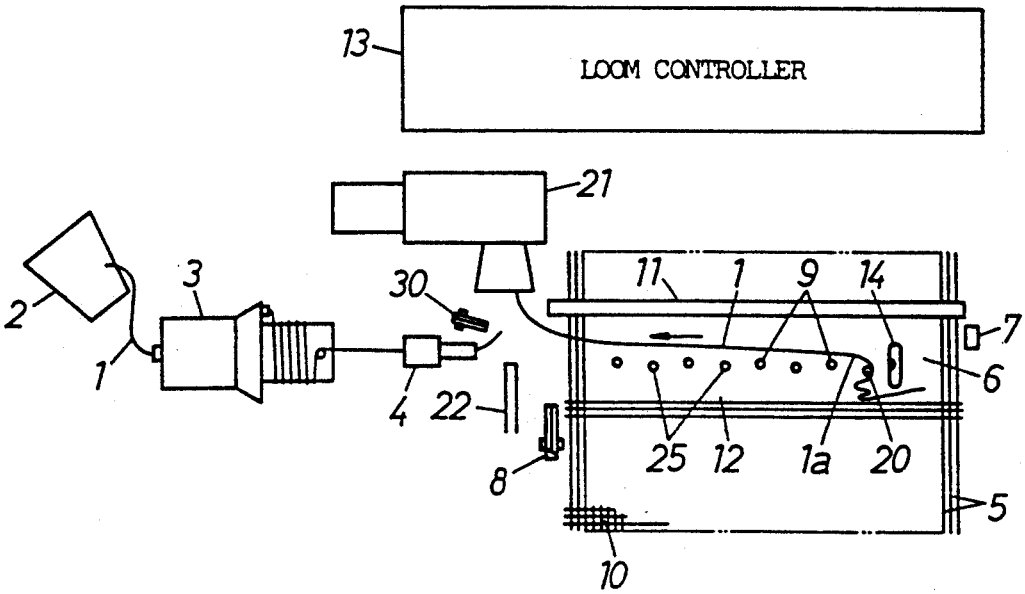

In pulling out the weft 1 and the mispicked weft 1*a* from the shed 6, the weft 1 extends via the yarn guide 20 in a V-shape as shown in FIG. 5, and hence the mispicked weft 1*a* is pulled toward the arriving side. Accordingly, the mispicked weft 1*a* extending along the cloth fell 12 between the upper and lower warps 5 is separated gradually from the cloth fell 12 being turned toward the arriving side, so that the mispicked weft 1*a* can be separated from the cloth fell 12 by pulling the same by a pulling force smaller than that necessary for separating the mispicked weft 1*a* by directly pulling the same toward the picking side. Since the mispicked weft 1*a* can be separated form the cloth fell 12 by a comparatively small force eve if the weft 1 is an easily entangling yarn or the fabric is of a weave hard to unravel, the mispicked weft 1*a* is hardly broken when pulled. Thus, the mispicked weft 1*a* can surly and quickly be removed regardless of the type thereof.

Since the weft 1 inserted in the shed 6 is held by the main picking nozzle 4, the weft 1 can surely be transferred to the mispicked weft removing device 21 disposed near the main picking nozzle 4.

The use of the driving device 24 is advantageous because the separation of the mispicked weft 1*a* from the cloth fell 12 is facilitated and the pulling force for pulling out the mispicked weft 1*a* can further be reduced when the pin-shaped yarn guide 20 is vibrated in appropriate directions or rotated in the pulling direction by the driving device 24.

Such an auxiliary pulling motion of yarn guide 20 assists separating the mispicked weft 1*a* from the cloth fell 12 to further ensure the operation for removing the mispicked weft 1*a*.

OTHER EMBODIMENTS

Figure 8:
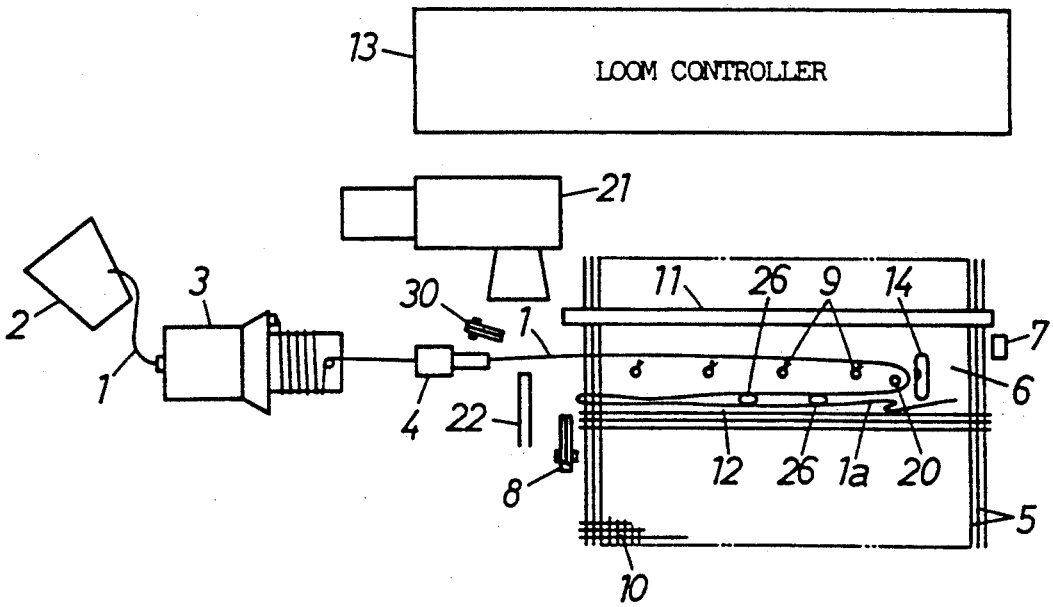
FIG. 8 is a plan view of a loom suitable for carrying out a mispicked weft removing method in accordance with a second embodiment of the present invention.

Referring to FIG. 8, a mispicked weft removing method in accordance with a second embodiment of the present invention employs a plurality of auxiliary suction nozzles 26 instead of the nozzles 25. The auxiliary suction nozzles 26 can be moved between a position inside the shed 6 and a position outside the shed 6. Each auxiliary suction nozzle 26 is provided with a suction opening on the backside thereof, namely, the side facing the left-off side of the loom. The auxiliary suction nozzles 26 are arranged before the yarn guide 20 with respect to the picking direction so as to be located near the cloth fell 12 when advanced into the shed 6 of the warps 5.

Figure 9:
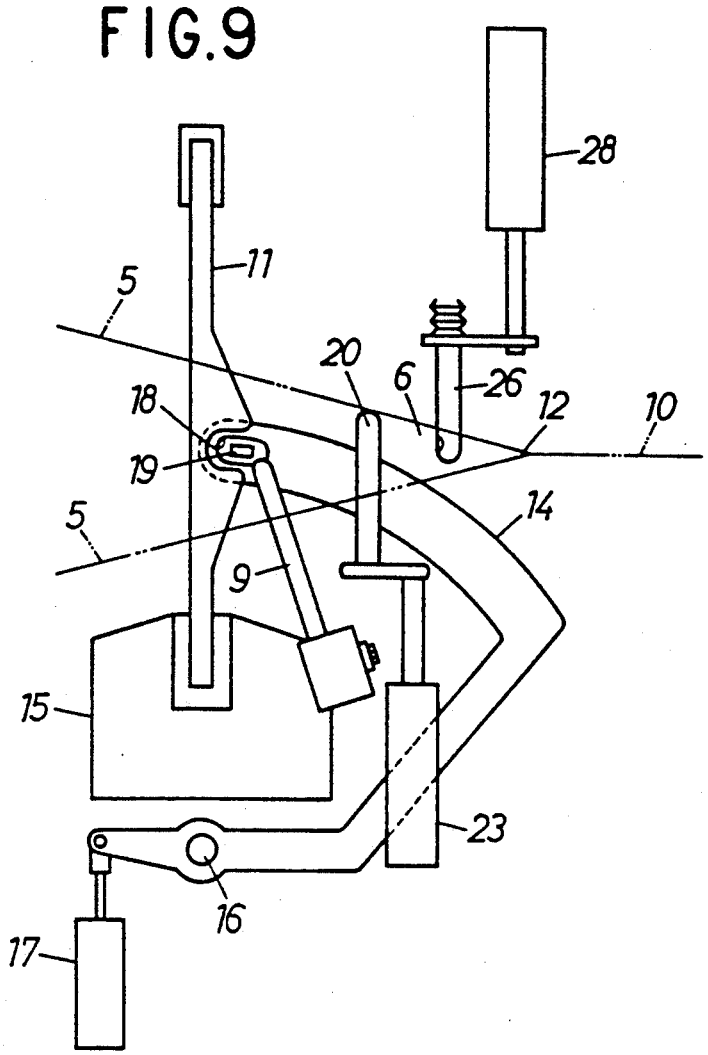
FIG. 9 is an enlarged side elevation of an auxiliary suction nozzle.

Referring to FIG. 9, the auxiliary suction nozzles 26 are advanced into the shed 6 by a pneumatic cylinder actuator 28 and start suction before the weft 1 of a predetermined length is inserted in the shed 6. Accordingly, the weft 1 inserted int he shed 6 and continuous with the mispicked weft 1*a* is moved toward and held near the cloth fell 12 by the suction of the auxiliary suction nozzles 26, so that the inserted weft 1 is able to extend stably in a loop. When the weft 1 of a predetermined length is inserted in the shed 6 or when the bend in the loop of the weft 1 is detected by a detector 19 disposed at a predetermined position, the yarn guide 20 is advanced into the shed 6, and then the foregoing mispicked weft removing procedure is carried out to remove the mispicked weft 1*a*.

Figure 10:
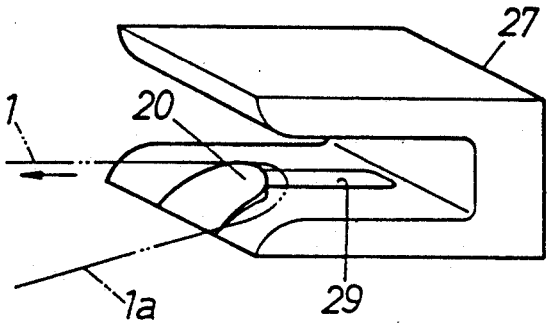
FIG. 10 is an enlarged perspective view of a yarn guide and a holder employed in accordance with carrying out a mispicked weft removing method in a third embodiment of the present invention.
Figure 11:
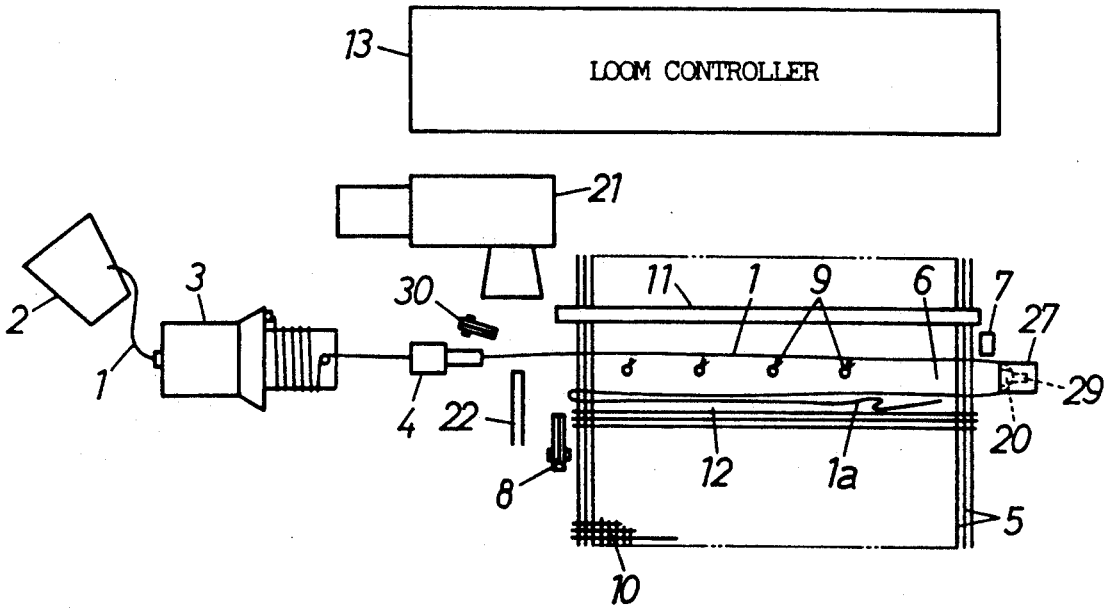
FIG. 11 is a plan view of a loom for carrying out a mispicked weft removing method in accordance with the third embodiment of the present invention.

A mispicked weft removing method in accordance with a third embodiment of the present invention employs a fixed yarn guide 20 as shown in FIG. 10 fixedly disposed outside the shed 6 on the arriving side of the loom as shown in FIG. 11. The yarn guide 20 is a projection projecting upward from the lower surface of a U-shaped holding member 27.

As the weft 1 continuous with the mispicked weft 1*a* is inserted in the shed 6, the bend in the loop of the weft 1 is pulled into the holding member 27 and held in place in the holding member 27 by suction produced by sucking air through a suction slit 29 formed in the lower portion of the holding member 27. In this state, the yarn guide 20 formed within the holding member 27 positioned inside the loop of the weft 1. When the mispicked weft removing device 21 applies a pulling force to the weft 1, the weft 1 engages the yarn guide 20 and slides around the yarn guide 20 in the direction of the pulling force.

What is claimed is:

1. A mispicked weft removing method comprising the steps of: keeping a mispicked weft continuous with a weft remaining in a main picking nozzle of a loom; reversing the loom to open a shed in which the mispicked weft is inserted; additionally inserting the weft in the shed using the main picking nozzle so that the weft extends in a loop in the shed; and pulling the weft inserted in the shed to remove the is picked weft continuous with the weft from the shed;

wherein a yarn guide is positioned in the loop of the weft before pulling the weft so that the mispicked weft is pulled via the yarn guide toward the picking side of the loom.

2. A mispicked weft removing method according to claim 1, wherein the yarn guide is driven for providing an auxiliary pulling motion.

3. A mispicked weft removing method comprising the steps of: keeping a mispicked weft continuous with a weft remaining in a main picking nozzle of a loom; reversing the loom to open a shed in which the mispicked weft is inserted; additionally inserting the weft in the shed by jetting a fluid using the main picking nozzle and also using auxiliary nozzles of the loom so that the weft extends in a loop in the shed; and pulling the weft to remove the mispicked weft continuous with the weft from the shed;

wherein a yarn guide is positioned in the loop of the weft so that the mispicked weft is pulled via the yarn guide toward the picking side of the loom.

4. A mispicked weft removing method according to claim 2, wherein the yarn guide is driven for providing an auxiliary pulling motion.

5. A mispicked weft removing method comprising the steps of: keeping a mispicked weft continuous with a weft remaining in a main picking nozzle of a loom; reversing the loom to open a shed in which the mispicked weft is inserted; additionally inserting the weft in the shed by jetting a fluid using the main picking nozzle so that the weft extends in a loop in the shed and a bend in the loop of the weft reaches a position outside the shed; and pulling the weft to remove the mispicked weft continuous with the weft from the shed;

wherein a yarn guide is positioned outside the shed on the arriving side of the loom so that the weft engages the yarn guide and the mispicked weft is pulled via the yarn guide toward the picking side of the loom when the weft is pulled toward the picking side of the loom.

6. A mispicked weft removing method according to claim 3, wherein the yarn guide is driven for providing an auxiliary pulling motion.

* * * * *